US010969163B2

(12) United States Patent
Lu et al.

(10) Patent No.: US 10,969,163 B2
(45) Date of Patent: Apr. 6, 2021

(54) REFRIGERATOR AND HUMIDITY CONTROL METHOD

(71) Applicant: QINGDAO HAIER JOINT STOCK CO., LTD., Qingdao (CN)

(72) Inventors: Riyong Lu, Qingdao (CN); Bin Fei, Qingdao (CN); Xueli Cheng, Qingdao (CN); Xiaodong Zhou, Qingdao (CN); Xiaobing Zhu, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 252 days.

(21) Appl. No.: 15/750,500

(22) PCT Filed: Jun. 17, 2016

(86) PCT No.: PCT/CN2016/086175
§ 371 (c)(1),
(2) Date: Feb. 5, 2018

(87) PCT Pub. No.: WO2017/113639
PCT Pub. Date: Jul. 6, 2017

(65) Prior Publication Data

US 2019/0024969 A1 Jan. 24, 2019

(30) Foreign Application Priority Data

Dec. 29, 2015 (CN) ..... 201511019467.1

(51) Int. Cl.
*F25D 11/02* (2006.01)
*F25D 29/00* (2006.01)
*F25D 17/04* (2006.01)

(52) U.S. Cl.
CPC ..... *F25D 29/003* (2013.01); *F25D 11/02* (2013.01); *F25D 17/042* (2013.01);
(Continued)

(58) Field of Classification Search
CPC ..... F25D 29/003; F25D 11/02; F25D 2317/04131; F25D 17/042; F25D 2700/14
See application file for complete search history.

(56) References Cited

U.S. PATENT DOCUMENTS 5,400,608 A * 3/1995 Steed ..... B60H 1/3232 62/91
6,354,572 B1 * 3/2002 Menassa ..... F24F 6/04 261/39.1
(Continued)

FOREIGN PATENT DOCUMENTS

CN 1553128 A 12/2004
CN 104359284 A 2/2015
(Continued)

OTHER PUBLICATIONS

Takeshi, Refrigerator, Oct. 13, 2013, Full Document (Year: 2013).*
(Continued)

*Primary Examiner* — Edward F Landrum
*Assistant Examiner* — Nael N Babaa
(74) *Attorney, Agent, or Firm* — Cheng-ju Chiang

(57) ABSTRACT

The present invention discloses a refrigerator and a humidity control method for the same. The refrigerator comprises a humidity controller to controllably maintain moisture and/or perform humidification. The humidity controller is configured to: set a target humidity value, measure an actual relative humidity value of a target space, and calculate a target water replenishing mass W based on a difference between the two values and a current temperature of the target space; measure and calculate a water replenishing time T, and adjust the humidity controller so as to maintain its maximum humidifying rate $V_{max}$ within the time T to achieve the humidification purpose; and adjust the humidity controller so as to maintain a humidifying rate consistent
(Continued)

with a water vapor loss rate in the target space to achieve the moisture maintaining purpose.

10 Claims, 5 Drawing Sheets

(52) U.S. Cl.
CPC *F25B 2700/02* (2013.01); *F25D 2317/04131* (2013.01); *F25D 2500/04* (2013.01); *F25D 2700/12* (2013.01); *F25D 2700/14* (2013.01)

(56) References Cited

U.S. PATENT DOCUMENTS

| | | | | |
|---|---|---|---|---|
| 2004/0086287 | A1* | 5/2004 | Minato | B41C 1/10 399/44 |
| 2014/0260355 | A1* | 9/2014 | Guess | F25D 23/126 62/78 |
| 2015/0221293 | A1* | 8/2015 | Hollander | G10D 3/00 84/453 |

FOREIGN PATENT DOCUMENTS

| | | | | |
|---|---|---|---|---|
| CN | 105466131 | A | 4/2016 | |
| CN | 105466146 | A | 4/2016 | |
| CN | 105571266 | A | 5/2016 | |
| CN | 105605872 | A | 5/2016 | |
| DE | 102007057192 | A1 * | 6/2009 | H01M 8/04522 |
| JP | 2006-349302 | A | 12/2006 | |
| JP | 2013257145 | A * | 12/2013 | |
| JP | 2016031163 | A * | 3/2016 | |

OTHER PUBLICATIONS

Takeshi, Refrigerator, Oct. 13, 2013, Google Patents, Full Document (Year: 2013).*

Sato, "Vaporization type humidifier in air conditioner", 2014, Full Document (Year: 2014).*

Jochen, "Device for humidifying gas", 2007, Full Document (Year: 2007).*

* cited by examiner

REFRIGERATOR AND HUMIDITY CONTROL METHOD

CROSS REFERENCE TO RELATED APPLICATIONS

The present application is a 35 U.S.C. § 371 National Phase conversion of International (PCT) Patent Application No. PCT/CN2016/086175, filed on Jun. 17, 2016, which further claims benefit of Chinese Patent Application No. 201511019467.1, filed on Dec. 29, 2015, the disclosure of which is incorporated by reference herein. The PCT International Patent Application was filed and published in Chinese.

TECHNICAL FIELD

The present invention is related to the technical field of refrigerating devices, and more particularly to a refrigerator and a humidity control method.

BACKGROUND

Moisture maintaining methods or humidifying methods may be employed to prevent excessively dry conditions of refrigerating compartments of refrigerators. Isolating membranes may be used in such moisture maintaining methods. By locking moisture evaporated from food within certain areas using isolating membranes, the relative humidity in these areas can reach a saturated state to mitigate moisture evaporation of food. However, isolating membranes cannot lock moisture by 100%, and the relative humidity concentration in the areas is uncontrollable. Molecular sieves may be used in said humidifying methods, which may include placing water in a container and isolating a side of the container using a molecular sieve which only allows outflow of water molecules. However, humidifying methods using molecular sieves still cannot control the relative humidity concentration in the areas.

The relative humidity (RH) in the areas can be controlled using a combination of RH sensors and ultrasonic humidifiers. A preset RH value may be achieved by presetting an RH value in a certain area and controlling the switching on/off of the ultrasonic humidifier according to output signals of the RH sensor in that area. However, the ultrasonic method of automatically controlling the RH is too costly and requires a relatively large space.

SUMMARY

The object of the present invention is to solve the humidity control problems of refrigerators.

To realize the above object, the present invention provides a humidity control method for a moisture maintaining space of a refrigerator, the moisture maintaining space comprising a humidity controller to controllably maintain moisture and/or perform humidification, the method comprising the steps of:

S1: setting a target humidity value $H_0$, and measuring a temperature $T_0$ and an actual relative humidity value h of the moisture maintaining space to obtain a $\Delta H$, which equals $H_0-h$;

S2: obtaining a target water replenishing mass W based on the $\Delta H$ and $T_0$;

S3: measuring and calculating a water replenishing time T, which equals $W/V_{max}$, wherein $V_{max}$ is the maximum humidifying rate of the humidity controller; and

S4: adjusting the humidity controller so as to maintain its maximum humidifying rate $V_{max}$ within the time T.

As an improvement of an embodiment of the present invention, the method further comprises step S5: adjusting the humidity controller so as to maintain a humidifying rate $V_m$, wherein $V_m$ is consistent with a water vapor mass loss rate $a_1$ in the moisture maintaining space, and $a_1$ is a constant related with the temperature $T_0$ of the moisture maintaining space.

As a further improvement of an embodiment of the present invention, step S2 comprises inquiring the Moisture Content of Saturated Wet Air at Different Temperatures look-up table based on the $\Delta H$ and $T_0$ to calculate the target water replenishing mass W.

To realize the above object, an embodiment of the present invention provides a refrigerator comprising a humidity controller, which is configured to perform any of the above methods and comprises a container and a humidifier, the container receiving an agent for use of humidifying and being provided with an opening to supply the agent to the humidifier.

As an improvement of an embodiment of the present invention, the opening of the container is adjustable to allow the humidity controller to reach a controlled humidifying rate.

As a further improvement of an embodiment of the present invention, the humidity controller comprises a driver to adjust the opening of the container.

As a yet further improvement of an embodiment of the present invention, the humidifying rate of the humidity controller is positively correlated with an opening area of the opening of the container.

As a yet further improvement of an embodiment of the present invention, the humidity controller further comprises a sub-controller which is capable of setting the target humidity value $H_0$.

As a yet further improvement of an embodiment of the present invention, the sub-controller sets moisture values of saturated wet air at different temperatures.

As a yet further improvement of an embodiment of the present invention, the humidity controller further comprises a temperature sensor and a humidity sensor.

Compared with the prior arts, the present invention can realize control of the RH of the moisture maintaining space. The device of the present invention is simple and solid in structure, small in size, easy in maintenance and low in cost.

DETAILED DESCRIPTION

The followings describe the present invention in detail with reference to the embodiments shown in the figures. However, these embodiments do not restrict the present invention. Modifications of the structures, methods or functions made based on these embodiments by those skilled in the art shall be embraced by the protection scope of the present invention.

According to an embodiment of the present invention, a refrigerator comprises at least one compartment. Independent moisture maintaining spaces such as boxes are arranged inside the compartment. Alternatively, the compartment may be a moisture maintaining space. A humidity controller is arranged inside the moisture maintaining space to adjust the relative humidity of the space.

Figure 1:
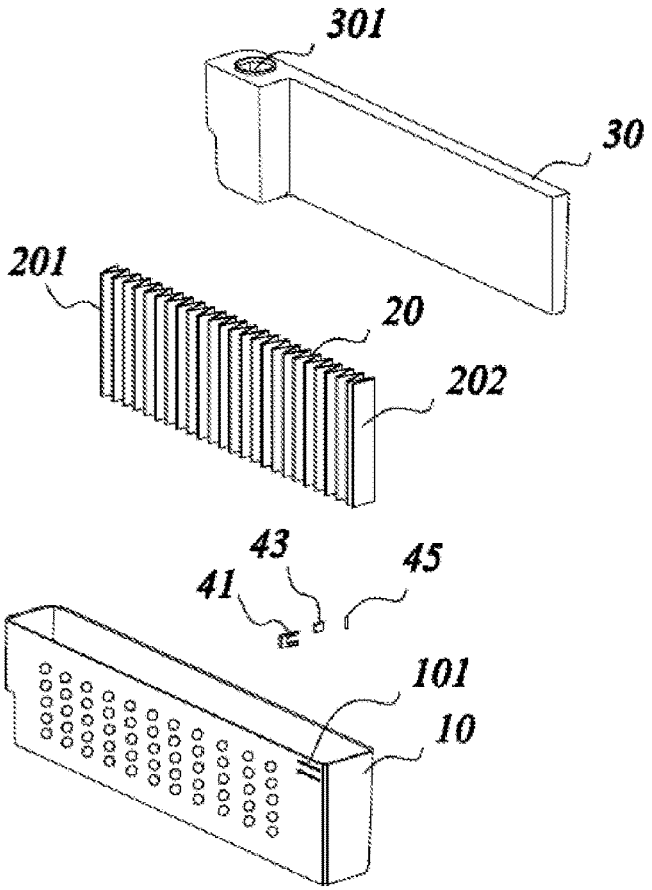
FIG. 1 is an exploded view of a humidity controller according to an embodiment of the present invention.

As shown in FIG. 1, the humidity controller comprises a housing 10, a humidifier 20 and a container 30.

The housing 10 comprises a bottom wall and side walls extending from the bottom wall. The bottom wall and the side walls together define a receiving chamber with an opening at the top portion. At least part of the side walls of the housing 10 is provided with several through holes to allow water vapor in the housing 10 to flow out.

Figure 2:
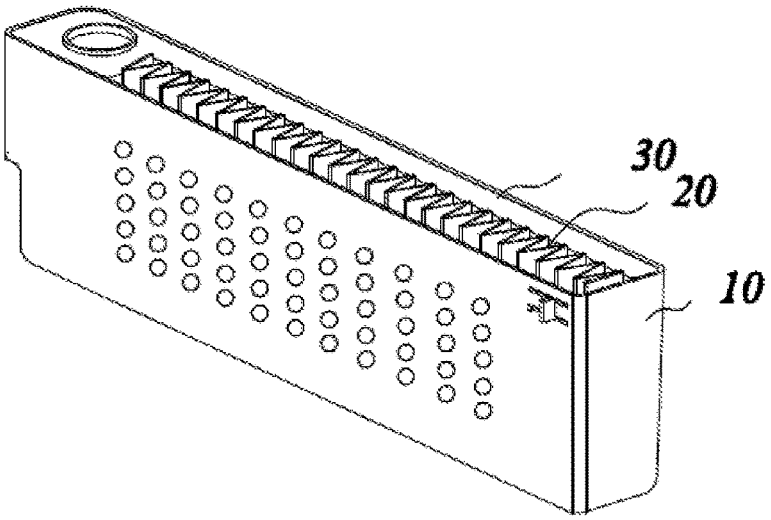
FIG. 2 is an assembled view of a humidity controller according to an embodiment of the present invention.

Referring to FIG. 2, the humidifier 20 is located within the housing 10 and is a stretchable and foldable structure formed by connecting several wet membranes head-to-tail. The wet membrane may be made of non-woven fabrics or other water-absorbing materials. One end of the humidifier 20 is fixed within the housing 10 and is defined as a proximal end 201. The other end of the humidifier 20 is adjustable and is defined as a distal end 202.

The container 30 is located within the housing 10 and neighbors the humidifier 20. The container 30 is used to receive an agent for use of humidifying, which is usually water. Openings are provided to the top and bottom of the container 30 respectively. The top opening 301 is an inlet for injecting the agent into the container 30. The bottom opening 302 is an outlet for injecting the agent into the receiving chamber of the housing 10 to maintain the humidity of the humidifier 20.

The proximal end 201 of the humidifier 20 is connected with the bottom opening 302 of the container 30. The wet membrane directly contacts the bottom opening 302 to guide the agent to flow to the entire humidifier 20.

In another embodiment of the present invention, the humidity controller further comprises an adjuster 40 for adjusting the unfolding degree of the humidifier 20 so as to adjust the humidity in the moisture maintaining space. Referring to FIG. 1, the adjuster 40 comprises a connector member 41 and a rotator 43 pivotably connected to the connector member 41.

Further, at least one elongate through hole is provided to the side wall of the housing 10 as a first slide groove 101 of the connector member 41. The rotator 43 is located inside the receiving chamber of the housing 10. The connector member 41 passes through the first slide groove 101 from the outer side of the housing 10 and is connected with the rotator 43. The connector member 41 comprises a body 411 and at least one connecting arm 413 extending from the body 411. The body 411 is located outside the housing 10. The connecting arm 413 passes through the first slide groove 101 and is connected with the rotator 43. The first slide groove 101 of the housing 10 extends horizontally. The connector member 41 may slide along the extending direction of the first slide groove 101 to adjust the unfolding degree of the humidifier 20.

The adjuster 40 further comprises a rotary shaft 45, through which the connector member 41 and the rotator 43 are pivotably connected.

Figure 3:
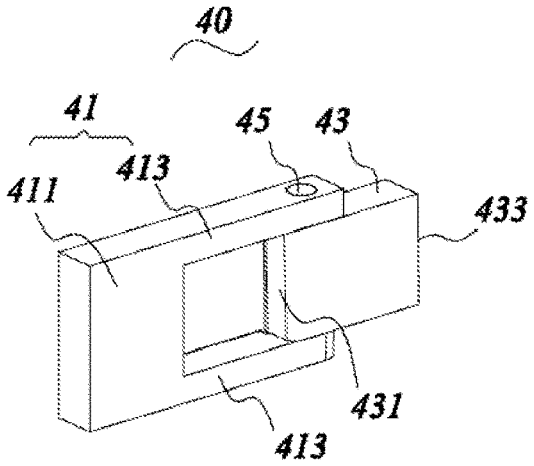
FIG. 3 is a schematic view showing a working state of an adjuster of a humidity controller according to an embodiment of the present invention.
Figure 4:
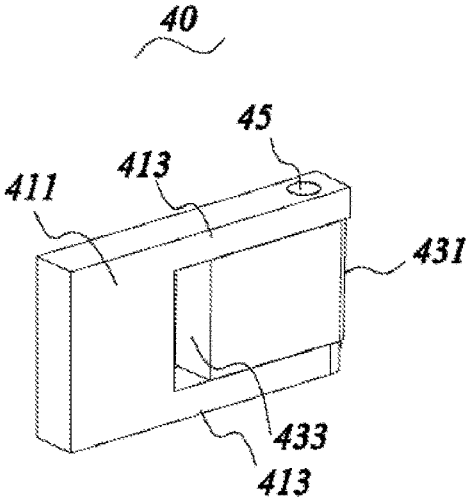
FIG. 4 is a schematic view showing a non-working state of an adjuster of a humidity controller according to an embodiment of the present invention.

FIGS. 3 and 4 schematically show that the connector member 41 has a U shape and two connecting arms 413. The space between the connecting arms 413 form the receiving space of the rotator 43 in the non-working state. Accordingly, the housing 10 is provided with two elongate through holes as first slide grooves 101 of the connector member 41. One end of the rotator 43 is connected to the rotary shaft and is taken as a fixed end 431, and the opposite end of the rotator 43 is taken as a movable end 433. The rotator 43 pivots around the rotary shaft 45. As shown in FIG. 3, when the movable end 433 rotates for the maximum distance away from the connector member 41, the adjuster 40 enters the working state and can define the unfolding degree of the humidifier 20. As shown in FIG. 4, when the movable end 433 rotates to the receiving space between the connecting arms 413, the adjuster 40 enters the non-working state.

Figure 5:
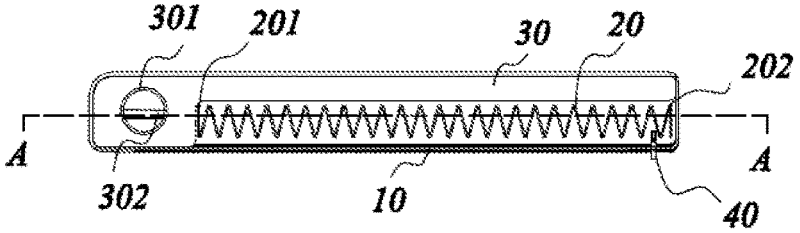
FIG. 5 is a plan view of a humidity controller according to an embodiment of the present invention.

Referring to FIGS. 3 and 5, when the adjuster 40 is in the non-working state, the rotator 43 is inserted between adjacent wet membranes at the distal end of the humidifier 20 to interfere with the same. The size of the first slide groove 101 matches with that of the connecting arm 413 so that the connecting arm 413 moves inside the first slide groove 101 under a proper frictional force, which is greater than the rebounding force of the humidifier 20. The wet membranes are made of non-woven fabrics or materials with small hardness, such as regenerated fibers. The humidifier 20 with a foldable structure has a small elastic coefficient. The interference of the adjuster 40 is sufficient to limit the distal end 202 of the humidifier 20, so that the humidifier 20 is maintained at the limited unfolding length.

In this way, by adjusting the unfolding degree of the humidifier 20 with the adjuster 40, the effective evaporation surface area of the humidifier 20 can be altered so as to realize moisture maintaining or humidifying of the moisture maintaining space. As water vapor in the compartment of the refrigerator is evaporated continuously and is carried away by convection air, properly adjusting the unfolding degree of the humidifier 20 can enable the water replenishing mass to be the same as the water vapor loss mass of the moisture maintaining space so as to realize moisture maintaining, or enable the water replenishing mass to be larger than the water vapor loss mass of the moisture maintaining space so as to realize humidifying.

Figure 6:
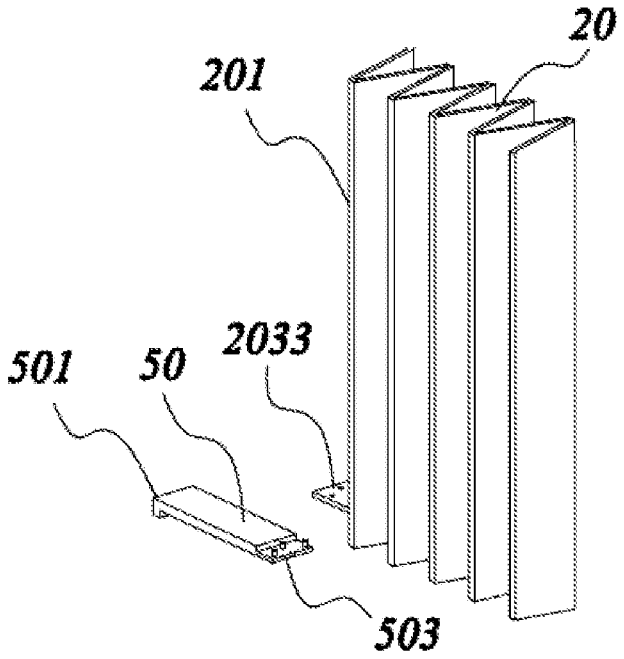
FIG. 6 is a schematic view of a humidifier (a part thereof) and a puller according to an embodiment of the present invention.

In yet another embodiment of the present invention, the humidity controller further comprises a puller 50, which is located at the bottom of the container 30 and may slide along the bottom of the container 30. The puller 50 may adjust the opening degree of the bottom opening 302 of the container 30 to adjust the flow rate of the agent. Referring to FIG. 6, one end of the puller 50 is connected to the proximal end 201 of the humidifier 20, so that the humidifier 20 can keep contact with the bottom opening 302 of the container 30.

Further, a second slide groove (not shown) in the lower surface of the bottom wall of the container 30 is formed near the bottom opening 302. The puller 50 cooperates with the shape of the second slide groove so as to slide in the second slide groove. The extending direction of the second slide groove may be the same as that of the foldable humidifier 20. The route of the puller 50 at least partially covers the bottom opening 302 of the container 30, so that the puller 50 can control the opening degree of the bottom opening 302 of the container 30 during the pulling process.

The puller 50 is in the shape of a strip. One end of the puller 50 is used as a handle for a sliding operation and is defined as a proximal end 501. The opposite end of the puller 50 is connected with the proximal end 201 of the humidifier 20 and is defined as a distal end 503.

Figure 7:
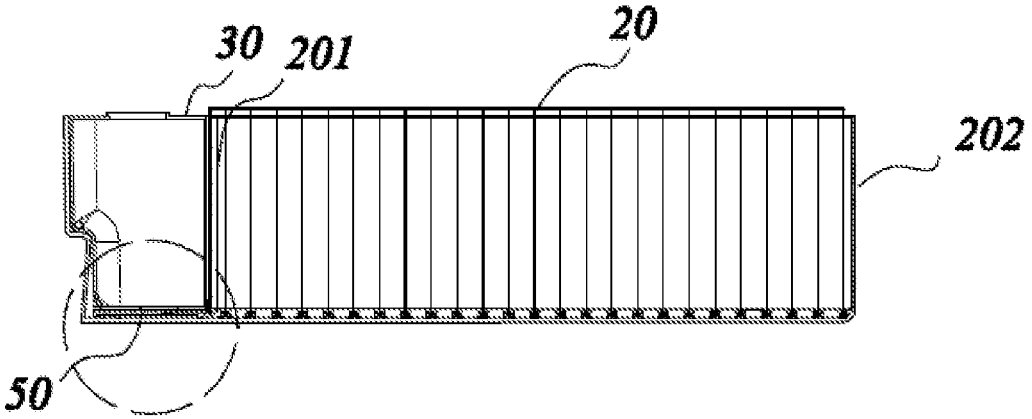
FIG. 7 is a sectional view of FIG. 5 cut along the AA direction.
Figure 8:
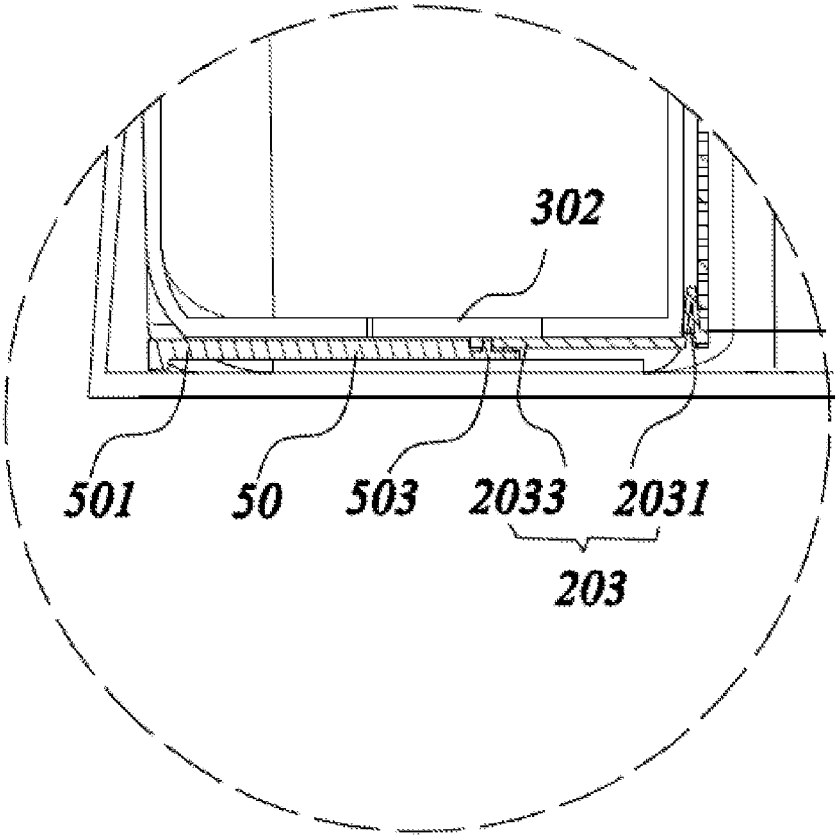
FIG. 8 is an exploded schematic view of the part in the dotted line box in FIG. 7.

Referring to FIGS. 6-8, the proximal end of the humidifier 20 includes an extender 203 whose main material is the same as that of the humidifier 20, namely, a non-woven fabric or other water absorbing materials. The extender 203 includes an inverted V-shaped folding portion 2031 and a connecting portion 2033 extending from the folding portion 2031. The folding portion 2031 reserves a space for the stretching of the extender 203. The connecting portion 2033 is provided with at least one hole. Correspondingly, the distal end 503 of the puller 50 is provided with a protrusion to match with the hole, so that the connecting portion 2033 can be connected with the distal end 503 of the puller 50. When the puller 50 moves along the second slide groove, the connecting portion 2033 of the extender 203 is driven to move together, and the folding portion 2031 stretches or contracts correspondingly. When the puller 50 moves, the opened portion of the bottom opening 302 of the container contacts the extender 203 of the humidifier 20, so that the agent is guided to flow to the body of the humidifier 20 via the extender 203. The opening area S of the bottom opening 302 is the contact area of the humidifier 20, and is positively correlated with the flow rate of the humidifying liquid.

In this way, by controlling the opening degree of the bottom opening 302 with the puller 50, the humidifying rate of the humidifier 20 can be adjusted, so that the humidity of the moisture maintaining space can be controlled.

Figure 9:
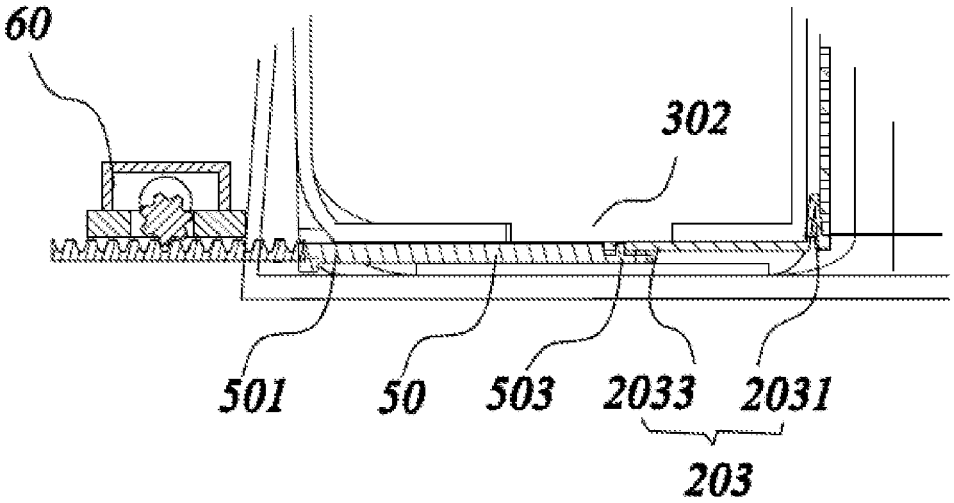
FIG. 9 is a local schematic view of a humidity controller according to an embodiment of the present invention.

In yet another embodiment of the present invention, the humidity controller further comprises a driver 60. Referring to FIG. 9, the driver 60 is connected to the proximal end 501 of the puller 50, and can drive the puller 50 to move along the second slide groove.

Further, the driver 60 comprises a step motor and a sub-controller to accurately adjust the movement distance of the puller 50.

In this way, the driver 60 can adjust the opening degree of the bottom opening 302 of the container, replenish the humidity in the moisture maintaining space to the preset target humidity value $H_0$, and maintain the humidity in the space by balancing the water vapor loss mass in the space through real-time water replenishment, thereby achieving the purposes of accurate humidifying and moisture maintaining.

Figure 10:
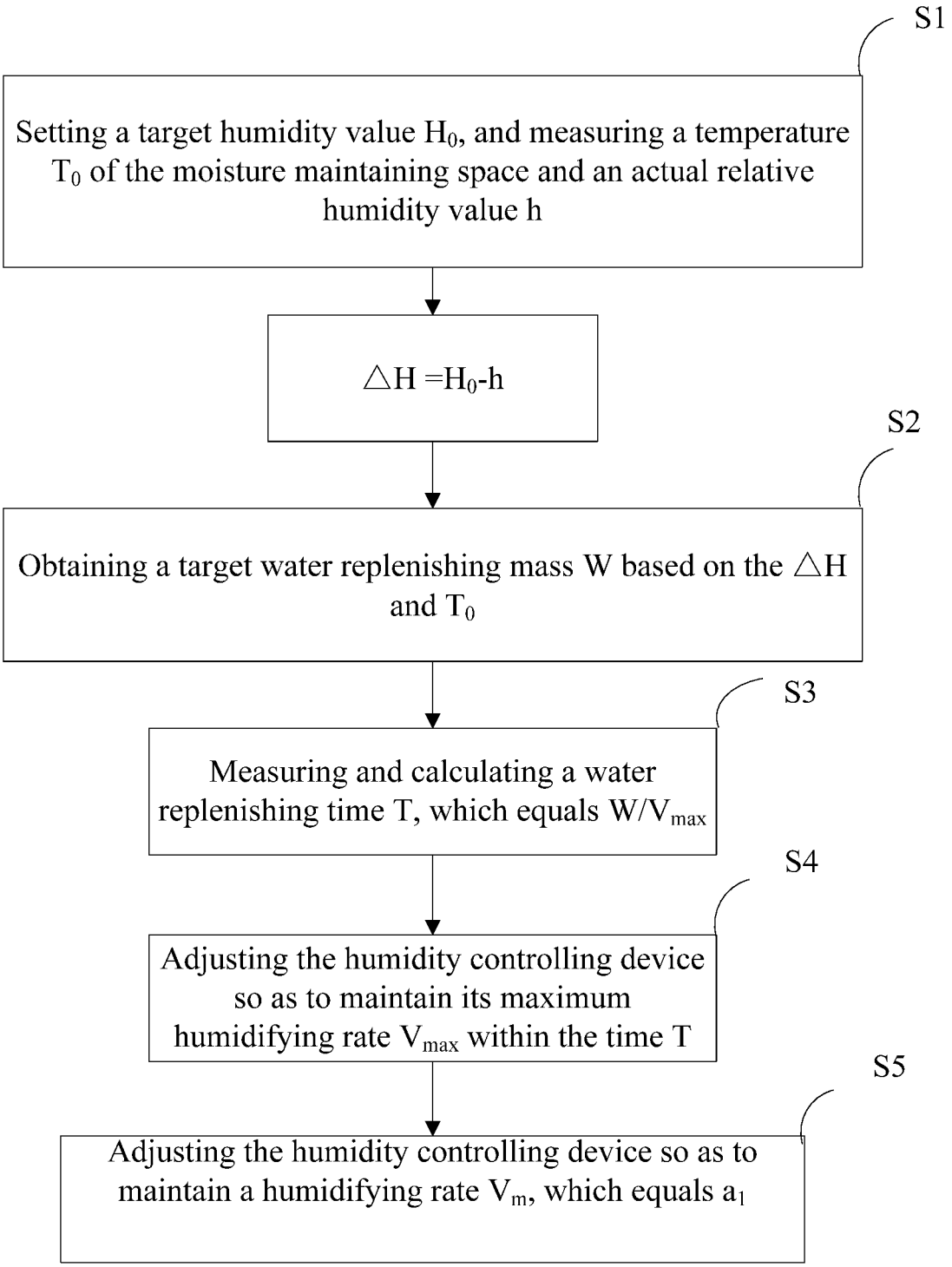
FIG. 10 is a flow chart of a humidify control method according to an embodiment of the present invention.

Specifically, referring to FIG. 10, the humidity control method comprises the following steps.

In step S1, a target humidity value $H_0$ is set, and a temperature $T_0$ and an actual relative humidity value h of the moisture maintaining space are measured.

The target humidity value $H_0$ may be preset by a user using the sub-controller. The temperature $T_0$ and the humidity value h are measured by a temperature sensor and a humidity sensor arranged in the compartment.

In step S2, a target water replenishing mass W in the moisture maintaining space is calculated by enquiring the Moisture Content of Saturated Wet Air at Different Temperatures look-up table based on the ΔH, and is related with the temperature $T_0$ and a volume of the moisture maintaining space, wherein ΔH equals $H_0$−h and is a difference between the target humidity value and the actual relative humidity value.

The sub-controller may preset the above look-up table and the calculation relations. Once the temperature $T_0$ is set, the value of W can be obtained.

In step S3, a water replenishing time T is measured and calculated. When the bottom opening of the container fully opens, water in the mass of W can be added into the humidifier 20 within the time T, which equals $W/V_{max}$. $V_{max}$ is the maximum humidifying rate when the bottom opening of the container fully opens, and can be measured through experiments.

The sub-controller may preset the above calculation relations. Once the temperature $T_0$ is set, the value of T can be obtained.

In step S4, the bottom opening 302 of the container fully opens within the time T through adjustment of the driver 60 to perform humidification.

In step S5, the opening area S of the bottom opening 302 of the container is adjusted to reach a humidifying rate $V_m$, and the humidifying rate $V_m$ of the container is measured and calculated, wherein $V_m$ is a flow rate of the humidifying liquid of the bottom opening of the container when the humidity in the moisture maintaining space is maintained at a constant. $V_m$ equals $a_1$, and $a_1$ is the water vapor mass loss rate of the moisture maintaining space.

$a_1$ is related with the temperature, air flow rate, position and volume of the moisture maintaining space, and its mean can be obtained through experiments and inference. The water vapor mass loss value is hardly affected by the relative humidity change in the moisture maintaining space, and its change can be neglected. For refrigerators of specific models, it may be deemed that $a_1$ is only related with the temperature $T_0$, and may be preset in the sub-controller.

When $V_m=a_1$, the water vapor mass loss rate $a_1$ of the moisture maintaining space is the same as the flow rate of the humidifying liquid in the container, so the relative humidity in the moisture maintaining space is maintained to be stable.

As mentioned above, the flow rate of the humidifying liquid is positively correlated with the opening area S of the bottom opening 302 of the container. By adjusting the opening area S of the bottom opening 302 of the container using the driver 60, the humidifying rate $V_m$ can be reached, thereby realizing the purpose of performing humidification.

The present method assumes that the moisture maintaining space is in the normal atmosphere to simplify calculations. It should be understood that those skilled in the art may adjust the humidity in the moisture maintaining space more accurately by calculating under different atmosphere pressures based on the teaching of the present application, and such embodiments shall also be embraced by the protection scope of the present application.

It should be understood that although the present description describes the present invention through the embodiments, each embodiment may include several technical solutions. The presentation manner of the present description only aims to make the descriptions clearer. Those skilled in the art should take the present description as an integral document. The technical solutions in the respective embodiments may be combined properly to form other embodiments which may be understood by those skilled in the art.

The above detailed descriptions are only descriptions of the feasible embodiments of the present invention, and are not intended to limit the protection scope of the present invention. Equivalent embodiments or modifications within the spirit of the present invention shall be embraced by the protection scope of the present invention.

What is claimed is:

1. A refrigerator comprising a humidity controller, wherein the humidity controller comprises a container and a humidifier, the container receiving an agent for use of humidifying and being provided with an opening to supply the agent to the humidifier, the humidifier is stretchable and foldable, and the humidity controller further comprises an adjuster for adjusting an unfolding degree of the humidifier so as to adjust humidity in a moisture maintaining space;

wherein the adjuster comprises a connector member and a rotator pivotably connected to the connector member; and the humidity controller further comprises a housing, the housing comprises a bottom wall and side walls extending from the bottom wall, the bottom wall and the side walls together define a receiving chamber with an opening at the top portion; a first slide groove which extends horizontally is provided to one of the side walls of the housing, the rotator is located inside the receiving chamber of the housing, the connector member passes through the first slide groove and is connected with the rotator, the connector member slides along the extending direction of the first slide groove to adjust the unfolding degree of the humidifier.

2. The refrigerator of claim 1, wherein the opening of the container is adjustable to allow the humidity controller to reach a controlled humidifying rate.

3. The refrigerator of claim 2, wherein the humidity controller comprises a driver to adjust the opening of the container.

4. The refrigerator of claim 2, wherein the humidifying rate of the humidity controller is positively correlated with an opening area of the opening of the container.

5. The refrigerator of claim 1, wherein the humidity controller further comprises a sub-controller which is capable of setting the target humidity value $H_0$.

6. The refrigerator of claim 1, wherein the humidity controller further comprises a temperature sensor and a humidity sensor.

7. The refrigerator of claim 1, wherein the rotator comprises a fixed end and a movable end opposite to the fixed end, and the adjuster comprises a working state and a non-working state; when the movable end rotates for the maximum distance away from the connector member, the adjuster enters the working state and the rotator interferes the humidifier, so that the humidifier is maintained at a limited unfolding length.

8. The refrigerator of claim 7, wherein the connector member comprises a body and at least one connecting arm extending from the body, the body is located outside the housing, the connecting arm passes through the first slide groove and is connected with the rotator, the connecting arm forms a receiving space, when the movable end rotates to the receiving space, the adjuster enters the non-working state and the rotator does not interferes the humidifier.

9. The refrigerator of claim 1, wherein a bottom opening is provided to bottom of the container, the bottom opening is an outlet for injecting the agent into the receiving chamber of the housing to maintain the humidity of the humidifier, the humidity controller further comprises a puller which adjusts the opening degree of the bottom opening of the container to adjust the flow rate of the agent.

10. The refrigerator of claim 9, wherein the puller is located at the bottom of the container and slides along the bottom of the container, a route of the puller at least partially covers the bottom opening of the container, so that the puller controls the opening degree of the bottom opening of the container during the pulling progress.

* * * * *